US005327197A

United States Patent [19]

Matsuura et al.

[11] Patent Number: 5,327,197

[45] Date of Patent: Jul. 5, 1994

[54] ELECTROPHOTOGRAPHIC APPARATUS

[75] Inventors: Yozo Matsuura; Hiromichi Ema, both of Tokyo; Shiroh Kondoh, Atsugi; Eiji Takenaka, Isehara; Hiroshi Saitoh, Ayase, all of Japan

[73] Assignee: Ricoh Company, Ltd., Tokyo, Japan

[21] Appl. No.: 88,737

[22] Filed: Jul. 8, 1993

[30] Foreign Application Priority Data

Jul. 8, 1992 [JP] Japan ..... 4-180945

[51] Int. Cl.[5] ..... G03G 5/00

[52] U.S. Cl. ..... 355/213; 355/211; 355/212

[58] Field of Search ..... 355/200, 210, 211, 212, 355/213

[56] References Cited

U.S. PATENT DOCUMENTS 3,941,472 3/1976 Nagahara et al. ..... 355/213
4,341,464 7/1982 Vola ..... 355/213
5,038,172 8/1991 Schreyer ..... 355/211
5,101,234 3/1992 Suzuki et al. ..... 355/213
5,262,826 11/1993 Hediger ..... 355/212

*Primary Examiner*—A. T. Grimley
*Assistant Examiner*—Sandra L. Brasé
*Attorney, Agent, or Firm*—Oblon, Spivak, McClelland, Maier & Neustadt

[57] ABSTRACT

An electrophotographic apparatus capable of forming a high quality image by a contact type developing system using a photoconductive belt and a developing roller. The belt has a tubular configuration. A single friction roller is made of rubber and received in the tubular belt to drive it in a rotary motion. The friction roller has an outside diameter smaller than the inside diameter of the belt to provide the belt with a slack. The developing roller contacts the slack of the belt and, therefore, contacts the belt over a sufficient nip width.

7 Claims, 5 Drawing Sheets

ELECTROPHOTOGRAPHIC APPARATUS

BACKGROUND OF THE INVENTION

The present invention relates to an electrophotographic apparatus capable of forming a high quality image by contact type development in which a photoconductive belt and a developing roller are held in contact.

Among conventional developing systems using a single component developer, i.e., a toner, a system of the type maintaining a blade in contact with a developing roller to charge and regulate the thickness of the toner is predominant. In the case of non-contact development wherein the developing roller does not contact a photoconductive element, it is necessary to apply an AC bias to the developing roller. This kind of development is generally referred to as a jumping development system. When the developing roller is operated in contact with a hard photoconductive element, the developing roller and photoconductive element make line-to-line contact since both of them are hard. The problem with the line-to-line contact is that the nip width of the developing roller and photoconductive element and, therefore, the contact thereof is extremely unstable. This is apt to result in a partly omitted image or similar defective image. Moreover, the linear velocity of the developing roller is usually three times to four times as high as that of the photoconductive element. Consequently, an extremely great torque is required to drive the developing roller and photoconductive element both of which are hard.

In the light of the above, it is a common practice with the contact type development to use a photoconductive element implemented as a belt. The belt is passed over and driven by two to three spaced rollers. The developing roller is held in contact with the belt at a particular position between the rollers over a predetermined nip width. The developing roller is rotated at a linear speed about three times as high as that of the belt. However, the rollers for supporting and driving the belt increase the number of parts and, therefore, the cost of the apparatus. In addition, the resulting belt unit is bulky to prevent the entire apparatus from being miniaturized.

SUMMARY OF THE INVENTION

It is therefore an object of the present invention to provide an electrophotographic apparatus which is simple in construction, small size, low cost and capable of forming a high quality image.

An electrophotographic apparatus for forming an image by an electrophotographic process of the present invention has a photoconductive belt having a tubular configuration, and a friction roller having an outside diameter smaller than the inside diameter of the photoconductive belt and received in the photoconductive belt. At least the surface of the friction roller is made of a material having high friction. A developing roller contacts a slack included in the photoconductive belt due to the difference between the outside diameter of the friction roller and the inside diameter of the photoconductive belt. The developing roller develops an electrostatic latent image formed on the photoconductive belt.

BRIEF DESCRIPTION OF THE DRAWINGS

The above and other objects, features and advantages of the present invention will become more apparent from the following detailed description taken with the accompanying drawings in which.

In the figures, the same or similar constituent parts are designated by the same reference numerals, and a detailed description will not be made to avoid redundancy.

DESCRIPTION OF THE PREFERRED EMBODIMENTS

Figure 1:
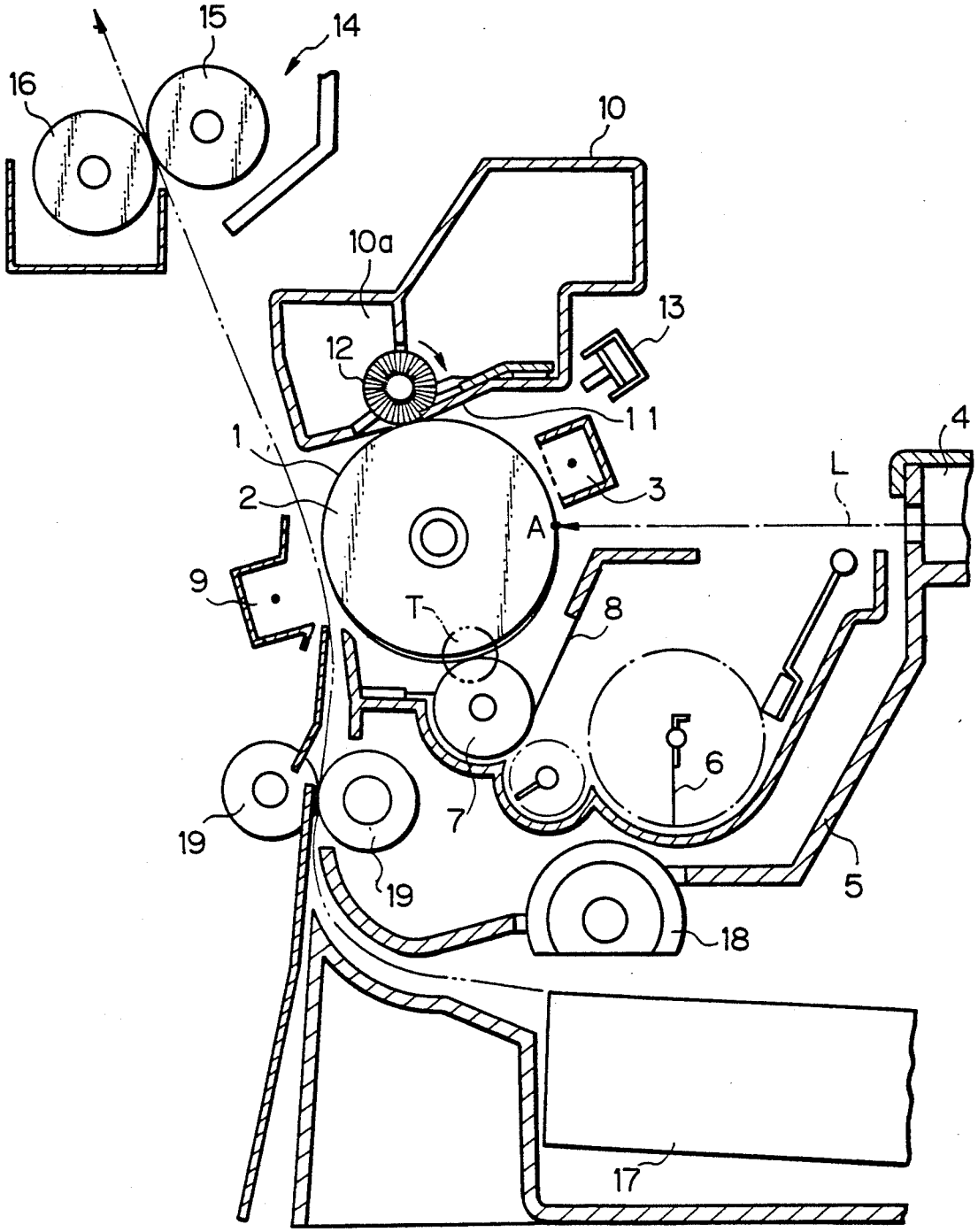
FIG. 1 is a section showing a first embodiment of the electrophotographic apparatus in accordance with the present invention.

Referring to FIG. 1 of the drawings, a first embodiment of the electrophotographic apparatus in accordance with the present invention is shown. As shown, the apparatus has a belt 1 whose opposite ends are connected to form a tube. A friction roller 2 is provided with a slightly smaller outside diameter than the inside diameter of the tubular belt 1 and received in the tube 1. The friction roller 2 is made of rubber having high friction. A main charger 3 uniformly charges the surface of the belt 1. Laser optics 4 emits a laser beam L for scanning the charged surface of the belt 1 at an exposing station A. A developing unit 5 has an agitator 6 for agitating a toner stored therein, a developing roller 7, a developing blade 8, etc. A cleaning unit 10 has a cleaning blade 11, a cleaning brush 12, etc. A waste toner tank 10*a* is contiguous with the cleaning unit 10. A fixing unit 14 is made up of a press roller 15 and a heat roller 16. The belt 1 has a slack T. There are also shown in the figure a transfer charger 9, a discharge lamp 13, a cassette 17 accommodating paper sheets or similar sheets, a pick-up roller disposed above the cassette 17 for feeding the paper sheets one by one, and a register roller pair 19.

The electrophotographic process of the first embodiment is conventional and will be outlined hereinafter. The laser beam L from the laser optics 4 scans the surface of the uniformly charged surface of the belt 1 to electrostatically form a latent image. As the latent image arrives at the developing unit 5, a thin toner layer deposited on the developing roller 7 by the blade 8 develops the latent image to form a corresponding toner image. A paper sheet fed from the cassette 17 by the pick-up roller 18 is once stopped by the register roller pair 19 ant then driven toward the belt 1 at predetermined timing. The transfer charger 9 transfers the toner image from the belt 1 to the paper sheet. The paper sheet carrying the toner image thereon is transported to the fixing unit 14 to have the toner image fixed. After the image transfer, the toner remaining on the surface of the belt 1 is removed by the blade 11 of the cleaning unit 10 and collected in the waste toner tank 10*a*. Before the belt 1 is charged by the main charger 3 again, the discharge lamp 13 illuminates it to reduce the surface potential to zero volt.

Figure 2:
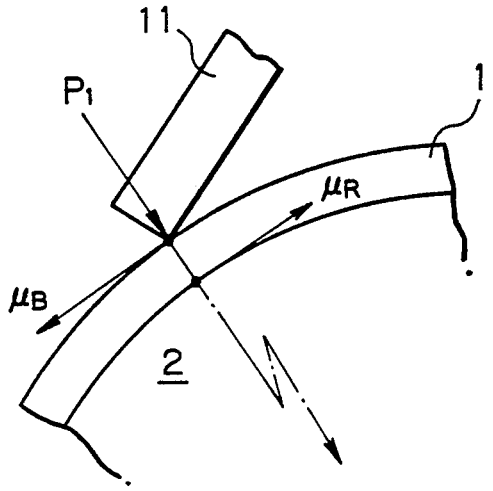
FIG. 2 is a view representative of a driving force acting on a photoconductive belt particular to the embodiment.

As shown in FIG. 2, the cleaning blade 11 constantly presses the belt 1 against the friction roller 2 by a pressure $P_1$. Assume that the coefficient of friction between the rear of the belt 1 and the blade 11 is $\mu_R$, and that the coefficient of friction between the front of the belt 1 and the blade 11 is $\mu_B$. Then, since the friction roller 2 has high friction and since the toner between the blade 11 and the belt 1 plays the role of a lubricant, there holds a relation:

$$\mu_R - \mu_B > 0$$

Therefore, when the friction roller 2 is rotated, the belt 1 is driven by a force expressed as $P_1 \cdot (\mu_R - \mu_B)$ in a relation of 1:1 to the roller 2.

Further, as shown in FIG. 1, the belt 1 has a slack T due to the difference in diameter between the belt 1 and the friction roller 2. The developing roller 7 is held in contact with the slack T of the belt 1. This allows the belt 1 and roller 7 to contact over a constant nip width, thereby insuring desirable contact type development. Moreover, even when the developing roller 7 is driven at a linear velocity which is three to five times as high as that of the belt 1, the torque for driving the roller 7 increases little since the belt 1 contacts the roller 7 at the slack T thereof.

To further increase the driving force $P_1 \cdot (\mu_R - \mu_B)$, the rear of the belt 1 that contacts the friction roller 2 may be provided with fine undulations for increasing the coefficient of friction. For this purpose, the base of the belt 1 may be implemented by an Ni (nickel) plated seamless belt whose inner surface is roughened in a pear-skin fashion. The pear-skin surface is readily obtainable if the surface of a mold for plating is provided with such a configuration.

Figure 3:
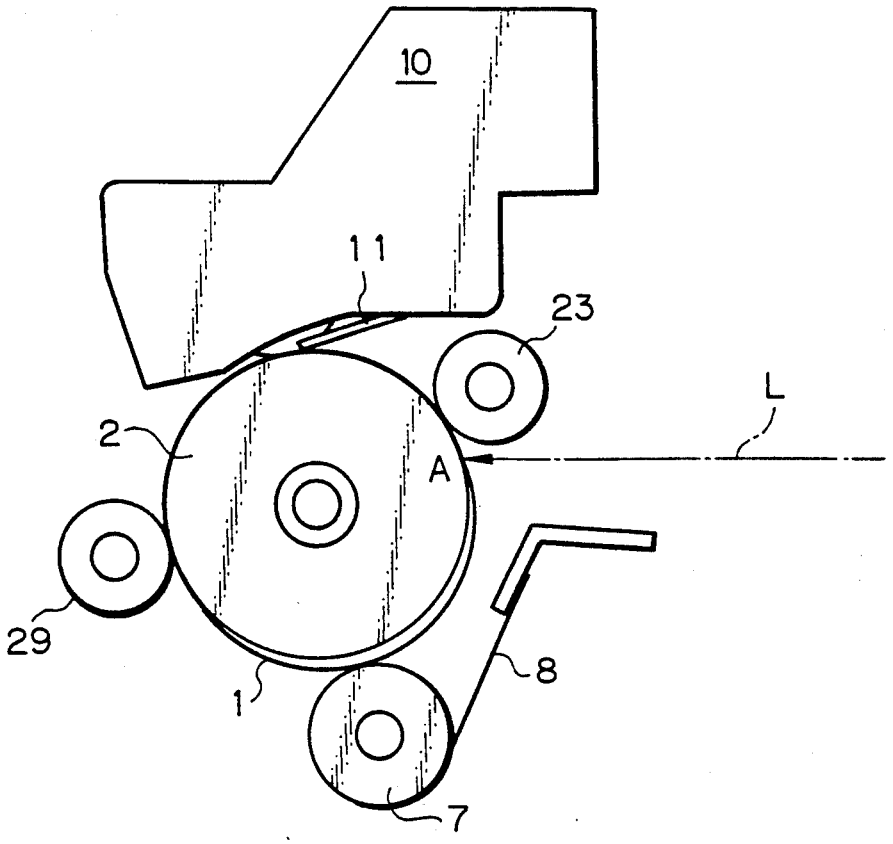
FIG. 3 is a fragmentary section showing a second embodiment of the present invention.
Figure 4:
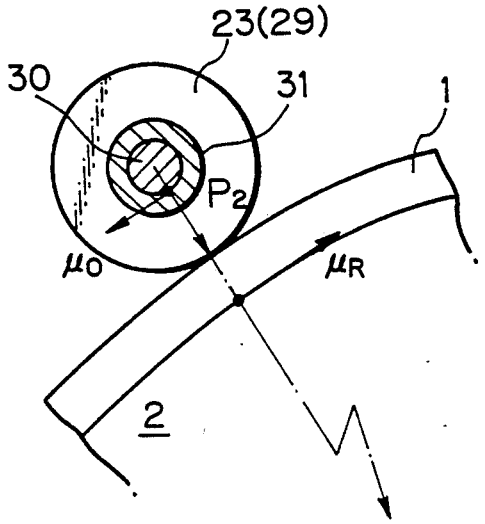
FIG. 4 is a view similar to FIG. 2, showing a driving force achievable with the second embodiment.

Referring to FIG. 3, a second embodiment of the present invention will be described. This embodiment is similar to the first embodiment except that the main charger 3 and the transfer charger 9 are replaced with a charge roller 23 and a transfer roller 29, respectively. FIG. 4 shows a shaft 30 supporting the roller 23 or 29, and a bearing 31 rotatably supporting the shaft 30. Assume that a pressure $P_2$ acts on the belt 1, and that the coefficient of friction between the shaft 30 and the bearing 31 is $\mu_O$. Then, there can be obtained a greater driving force of $P_2 \cdot (\mu_R - \mu_O)$, where $P_2 \cdot \mu 0$ is nearly equal to zero. This allows the belt 1 to be transported in a more stable manner.

Further, the charge roller 23 presses the belt 1 at a position adjoining the station A, FIG. 1, where the laser optics 4 exposes the belt 1. Hence, the belt 1 is prevented from oscillating at the station A despite the slack T thereof, so that an image can be accurately written on the belt 1.

Figure 5:
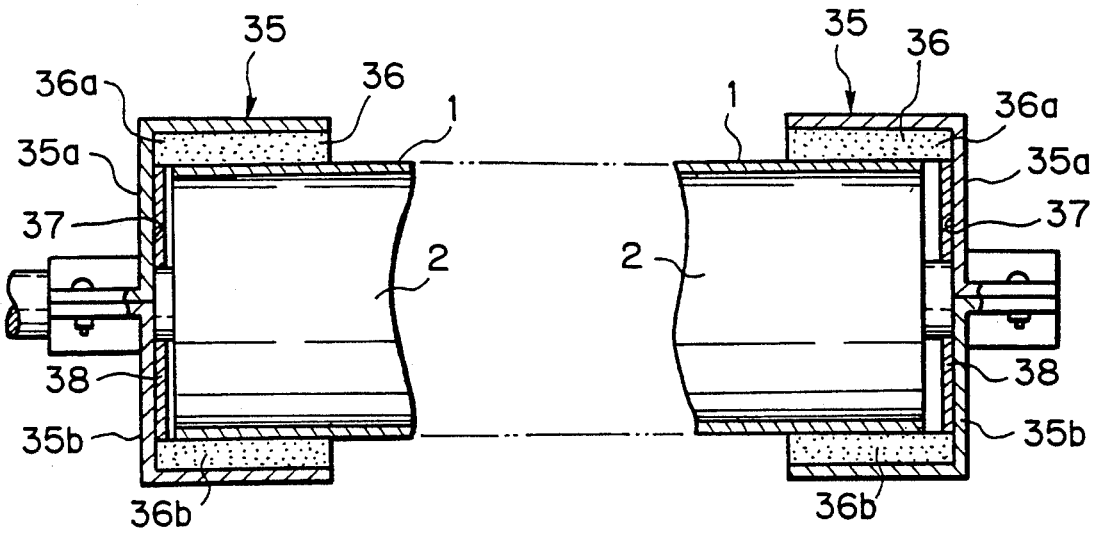
FIG. 5 is a fragmentary section showing a third embodiment of the present invention.
Figure 6:
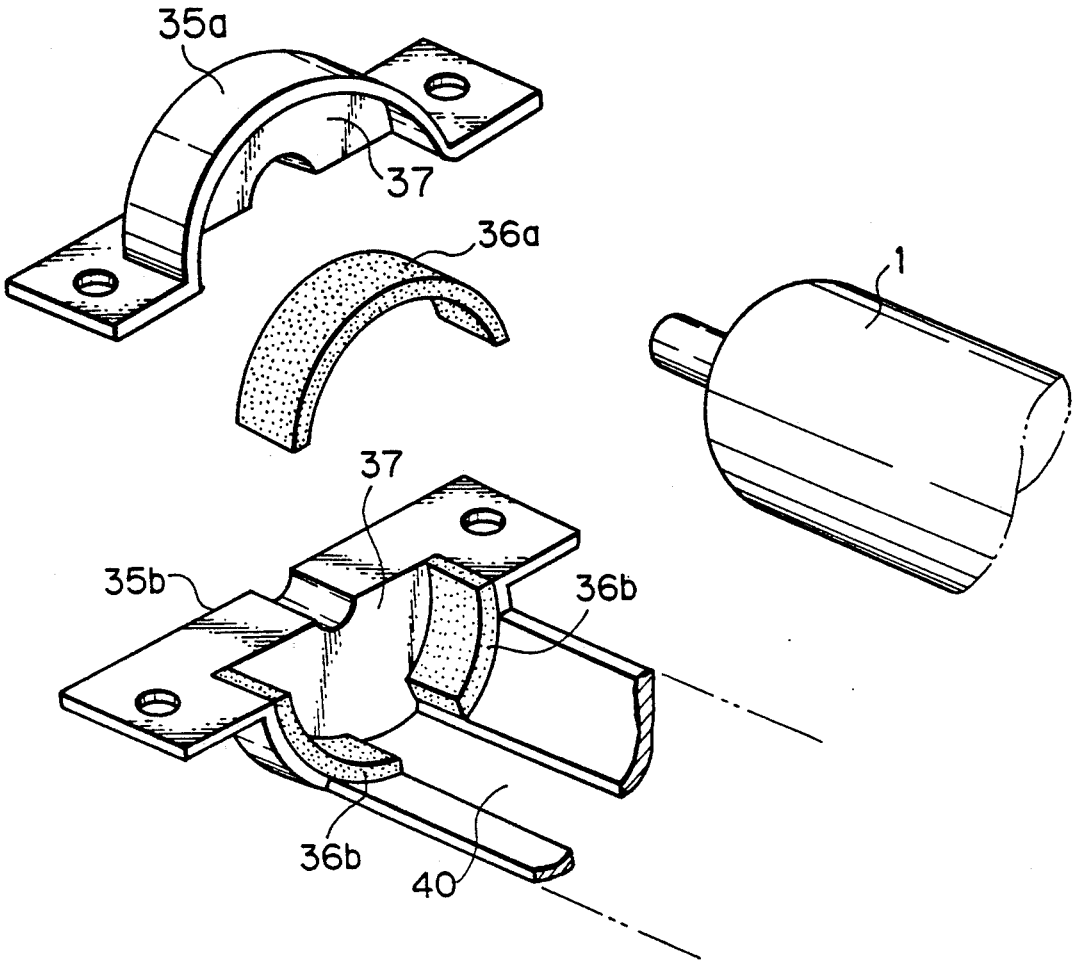
FIG. 6 is a fragmentary exploded perspective view of the third embodiment.
Figure 7:
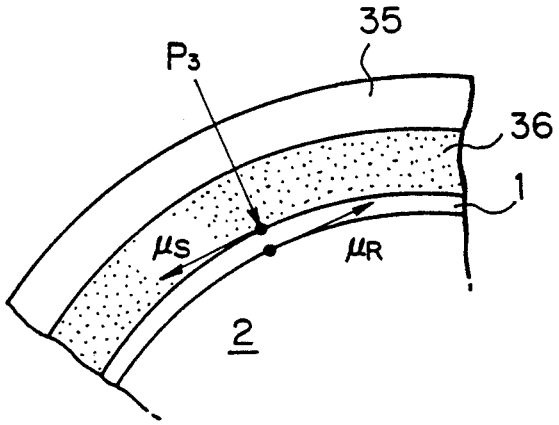
FIG. 7 is a view also similar to FIG. 2, showing a driving force achievable with the third embodiment.

FIGS. 5 and 6 show a third embodiment of the present invention. As shown, the belt 1 and friction roller 2 have their axially opposite ends covered with cylindrical covers 35. An elastic member 36 is disposed between each cover 35 and the associated end of the belt 1. The belt 1 is pressed against the roller 2. Each cover 35 is made up of an upper part 35*a* and a lower part 35*b*. Likewise, each elastic member 36 is constituted by an upper part 36*a* and a lower part 36*b*. The upper and lower cover parts 35*a* and 35*b* each has an inner wall 37 facing the associated end of the belt 1 and roller 2. A smooth member 38 made of a highly slippery material is provided on the inner wall of each cover part 35*a* or 35*b*.

In this embodiment, the opposite ends of the belt 1 are pressed against the friction roller 2 by the elastic members 36, as stated above. Hence, assuming that a pressure $P_3$ acts on the belt 1, and that the coefficient of friction between the elastic members 36 and the surface of the belt 1 is $\mu_S$, then a driving force as great as $P_3 \cdot (\mu_R - \mu_S)$ is achievable.

Figure 8:
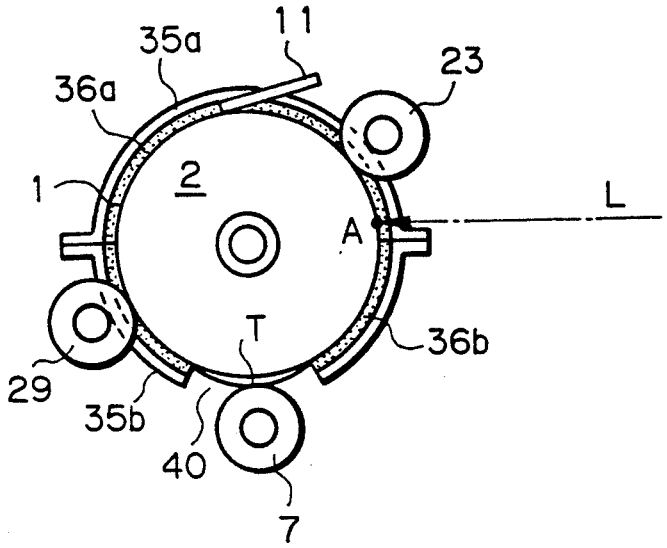
FIG. 8 is a sectional side elevation of the third embodiment.

As shown in FIG. 8 also, each lower cover 35*b* is formed with a slit 40 to allow the belt 1 to form the slack T at the lower end thereof. The elastic members 36 press the belt 1 against the friction roller 2 at the station A where the laser beam L scans the belt 1, thereby preventing the belt 1 from oscillating at the station A due to the slack T.

Assume that the belt 1 is shifted relative to the friction roller 2 in the thrust direction. Then, the inner wall 37 of the cover 35 and the associated end of the belt 1 contact each other via the smooth member 38. As a result, the belt 1 is preventing from being dislocated to either side relative to the roller 2. Even when the belt 1 is dislocated, the end of the belt 1 simply slides on the smooth member 38. This reduces the resistance to the slide of the belt 1 and, therefore, the required torque.

Figure 9:
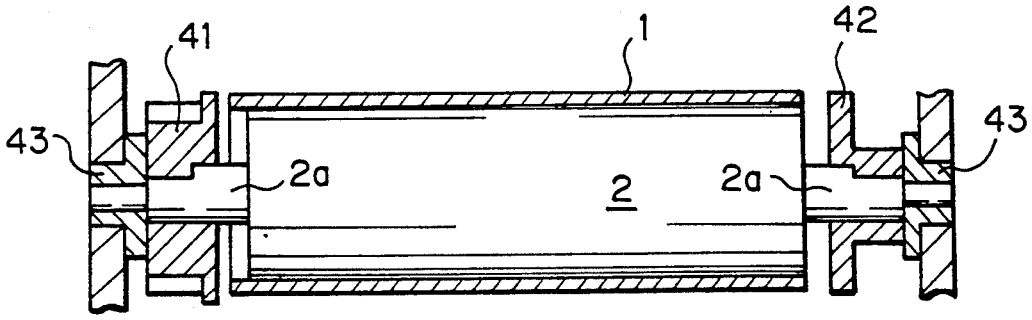
FIG. 9 is a fragmentary section showing a fourth embodiment of the present invention.

Referring to FIG. 9, a fourth embodiment of the present invention is shown. As shown, the friction roller 2 is mounted on a shaft 2*a* which is rotatably supported by bearings 43 at opposite ends thereof. A drive gear 41 is mounted on the shaft 2*a* at one side of the roller 2 while a stop 42 is mounted on the shaft 2*a* at the other side of the roller 2. The belt 1, therefore, faces the drive gear 41 and stop 42 at opposite ends thereof. In addition, the roller 2 and the drive gear 41 and stop 42 are rotatable integrally with each other. In this configuration, when the belt 1 is shifted relative to the roller 2 in the thrust direction, one end of the belt 1 abuts against the drive gear 41 or the stop 42 with the result that the belt 1 is prevented from becoming offset. Moreover, since the belt 1, drive gear 41 and stop 42 rotate at the same speed and in the same direction via the roller 2 and shaft 2*a*, the resistance to the slide of the belt 1 on the drive gear 41 or the stop 42 is reduced. This in turn reduces the required torque for driving the belt 1.

In the embodiments shown and described, it is not necessary that the friction roller 2 be entirely made of rubber. The gist is that at least the surface of the roller 2 be made of a high friction material.

In summary, it will be seen that the present invention provides an electrophotographic apparatus having various unprecedented advantages, as enumerated below.

(1) A tubular photoconductive belt is supported by a single friction roller and held in contact with the roller at the inner periphery thereof. This, coupled with the fact that a developing roller contacts a slack included in the belt, allows the belt and developing roller to effect contact type development over a sufficient nip width and under a light load condition.

(2) Fine undulations are provided on the base of the belt to increase the contact resistance between the belt and the friction roller. As a result, the force for transporting the belt is increased.

(3) The belt contacts a charge roller and a transfer roller as well. Hence, the contact of the belt with the friction roller and, therefore, the transport of the belt is stabilized to insure desirable image formation.

(4) The belt is pressed against the friction roller with the intermediary of elastic members. This is also successful in stabilizing the transport of the belt and, therefore, in promoting desirable image formation.

(5) Even when the belt is shifted to either side into contact with a drive gear or a stop, it is prevented from becoming offset since it rotates at the same speed and in the same direction as the drive gear and stop. This can be done without increasing the torque during the course of drive.

(6) Covers for protection prevent the belt from being shifted.

(7) In the case where the belt is prevented from becoming offset by abutting against either of the covers, a highly smooth member is provided on each cover. This reduces the contact resistance and, therefore, prevents the required torque from increasing during the course of drive.

Various modifications will become possible for those skilled in the art after receiving the teachings of the present disclosure without departing from the scope thereof.

What is claimed is:

1. An electrophotographic apparatus for forming an image by an electrophotographic process, comprising:

a photoconductive belt having a tubular configuration;

a friction roller having an outside diameter smaller than an inside diameter of said photoconductive belt and received in said photoconductive belt, at least a surface of said friction roller being made of a material having high friction; and a developing roller contacting a slack of said photoconductive belt which is ascribable to a difference between the outside diameter of said friction roller and the inside diameter of said photoconductive belt, said developing roller developing an electrostatic latent image formed on said photoconductive belt.

2. An apparatus as claimed in claim 1, wherein said photoconductive belt has a base which is provided with fine undulations on a side thereof contacting said friction roller.

3. An apparatus as claimed in claim 1, further comprising a charge roller and a transfer roller each contacting said photoconductive belt.

4. An apparatus as claimed in claim 1, further comprising a pair of elastic members each being provided on one of axially opposite ends of said photoconductive belt for elastically pressing said photoconductive belt against the surface of said friction roller.

5. An apparatus as claimed in claim 1, further comprising a drive gear and a stop provided at axially opposite sides of and rotatable integrally with said photoconductive belt.

6. An apparatus as claimed in claim 1, further comprising a pair of covers covering outer periphery of axially opposite ends of said photoconductive belt and said friction roller.

7. An apparatus as claimed in claim 6, further comprising a highly smooth member provided on a part of each of said covers which faces the associated end of said photoconductive belt.

* * * * *